United States Patent [19]

Pharo

[11] Patent Number: 4,793,123

[45] Date of Patent: Dec. 27, 1988

[54] ROLLED-UP PACKAGING SYSTEM AND METHOD

[76] Inventor: Daniel A. Pharo, 1901 Avenue of the Stars, Suite 450, Los Angeles, Calif. 90067

[21] Appl. No.: 120,655

[22] Filed: Nov. 16, 1987

[51] Int. Cl.[4] ..... B65B 23/00; B65B 55/20; B65B 11/56

[52] U.S. Cl. ..... 53/449; 53/469; 53/472; 206/522; 383/3; 383/38

[58] Field of Search ..... 53/472, 434, 457, 469, 53/449, 430; 206/522; 383/3, 38

[56] References Cited

U.S. PATENT DOCUMENTS

| | | | |
|---|---|---|---|
| 3,667,593 | 6/1972 | Pendleton | 53/472 X |
| 3,889,743 | 6/1975 | Presnick | 206/522 X |
| 4,044,867 | 8/1977 | Fisher | 206/522 X |
| 4,235,065 | 11/1980 | Freeman | 53/472 |
| 4,551,379 | 11/1985 | Kerr | 206/522 X |
| 4,569,082 | 2/1986 | Ainsworth et al. | 383/3 |
| 4,581,764 | 4/1986 | Plock et al. | 53/434 X |
| 4,597,244 | 7/1986 | Pharo | 53/434 |

*Primary Examiner*—Horace M. Culver

*Attorney, Agent, or Firm*—Phillips, Moore, Lempio & Finley

[57] ABSTRACT

A packaging system comprises a rolled-up bag generally assuming a spiraled configuration and defining an inflatable chamber therein adapted to be at least partially filled with a filler medium, such as pressurized air. A pouch is secured on the bag for retaining an article within the confines thereof. The bag is adapted to be pre-placed within a closeable box and the article then placed in the pouch, or, alternatively, the article can be placed in the bag, the bag rolled-up and then placed in the box. The bag is then inflated to at least substantially encapsulate and support the pouch and article within rolled-up portions of the bag.

26 Claims, 2 Drawing Sheets

ROLLED-UP PACKAGING SYSTEM AND METHOD

TECHNICAL FIELD

This invention relates generally to a packaging system and method and more particularly to an inflatable bag adapted to be rolled-up to assume a spiralled configuration for retaining an article therein.

BACKGROUND ART

U.S. Pat. No. 4,597,244, issued on July 1, 1986 to Daniel A. Pharo for "Method For Forming An Inflated Wrapping," discloses a packaging within an inflated, sealed bag. The present invention provides certain improvements and variations over the packaging system and method taught in Applicant's above patent.

DISCLOSURE OF INVENTION

The packaging system of this invention comprises a rolled-up bag generally assuming a spiralled configuration and defining a chamber therein adapted to be at least substantially filled with a filler medium. An open-ended pouch is formed on the bag for retaining an article therein with the pouch being disposed within the confines of overlying rolled-up portions of the bag. A filling means is provided for at least substantially charging the chamber with the filler medium to at least substantially encapsulate and support the pouch and article within the rolled-up portions of the bag.

In carrying forth the method steps of this invention, a package is first formed to comprise the inflatable bag and open pouch, an article is placed in the pouch, the bag is rolled-up to dispose the pouch and article within the confines of the bag, and the bag is at least partially filled with the filler medium to retain the article therein. In certain packaging applications, the bag is placed in a box either before or after the article is placed in the pouch.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
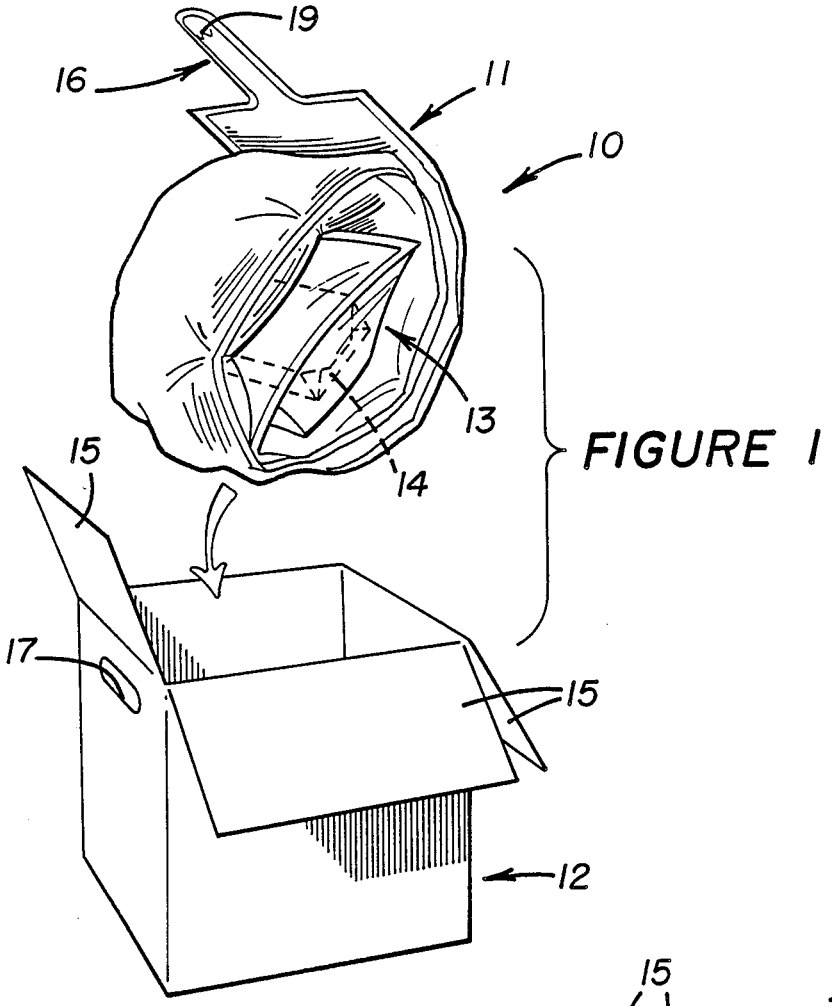
FIG. 1 is a perspective view illustrating a rolled-up bag, embodying a packaging system of this invention, being inserted into a box.
Figure 2:
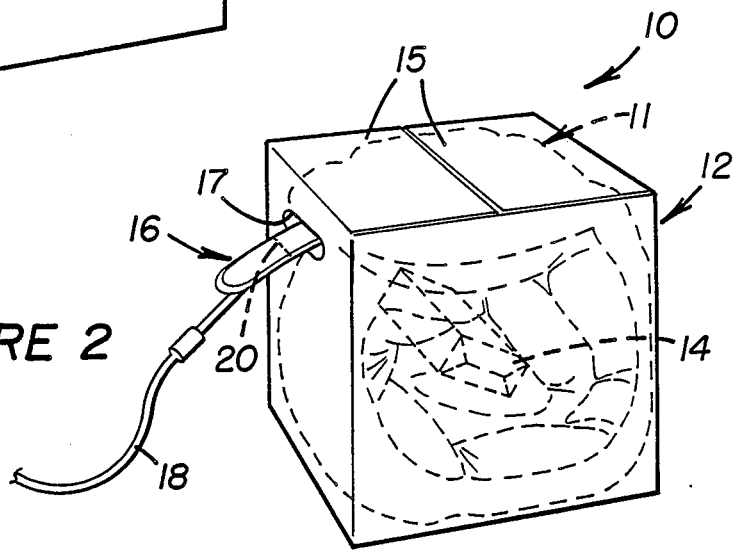
FIG. 2 is a perspective view illustrating disposition of the bag in the closed box and means for inflating the bag.

FIGS. 1 and 2 illustrate a packaging system 10 comprising a rolled-up bag 11 adapted to be placed within a closeable box or carton 12. As described more fully hereinafter, an open-ended pouch or pocket 13 is formed on the bag for retaining an article 14 therein, such as a gift. When the bag assumes its spiralled configuration illustrated in FIGS. 1 and 2, the pouch and article are disposed within the confines of overlying rolled-up portions of the bag.

When the rolled-up bag is positioned in box 12, closure flaps 15 of the box are superimposed and sealed together in a conventional manner. Filling means, shown in the form of a filling stem 16 of the bag, extends through an slot-like opening 17, formed through a side panel of box 12, to facilitate at least partial filling of the bag with a filler medium, such as pressurized air. In the embodiment illustrated, a filling tube 18, suitably connected to a pressurized air source (not shown), is inserted through a cut line 19 formed in stem 16.

After the bag has been inflated to charge a closed chamber defined within the bag with air to at least substantially encapsulate and support pouch 13 and article 14 within rolled-up portions of the bag, the stem is sealed by a heat-induced seam 20 formed transversely across the filling stem, as depicted by dash lines 20 in FIG. 2. The stem is then inserted into the box, through slot-like opening 17, to ready the formed packaging system for consumer consumption. The opening can be closed and sealed by a standard adhesive tape.

Figure 3:
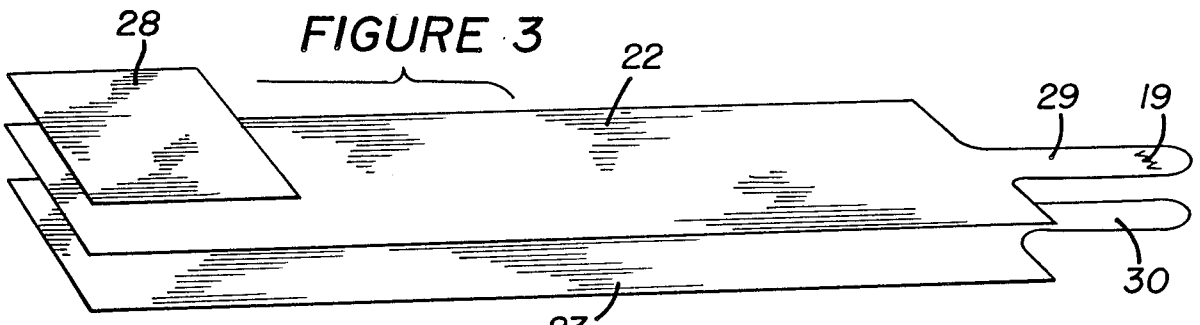
FIG. 3 is an exploded isometric view illustrating three panels utilized to form the bag and an article-retaining pouch thereon.

As shown in FIG. 3, bag 11 is preferably formed from a pair of overlying first and second panels 22 and 23, respectively. The panels are preferably at least generally rectangular and have outer peripheral edges thereof heat-sealed, glued or otherwise suitably secured together to define an inflatable chamber therebetween. The substantially co-extensive panels are sealed together about their peripheries in a conventional manner to define opposite first and second seams 24 and 25 at the ends of the bag and opposite side seams 26 and 27. Alternatively, the panels could be preformed as a tube, i.e., seamless at 26 and 27.

Figure 4:
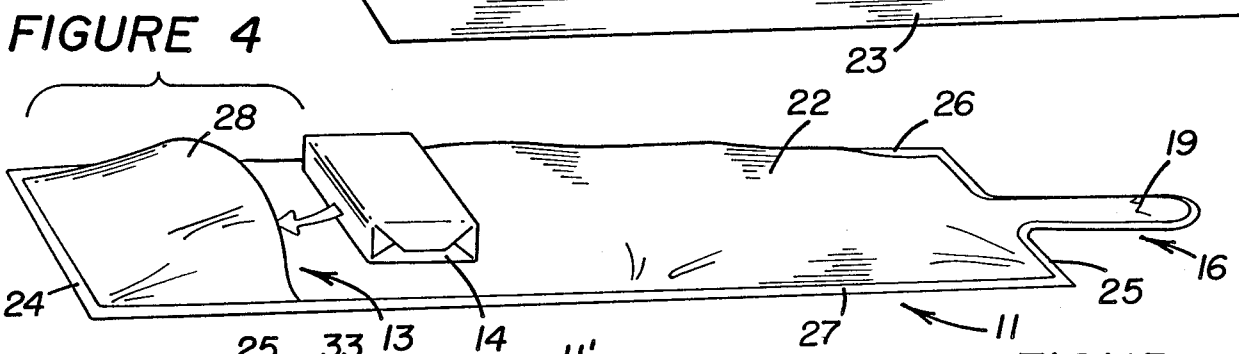
FIG. 4 is an isometric view illustrating the formed bag with its panels sealed together to define the pouch and an article adapted to be inserted into the pouch.
Figure 5:
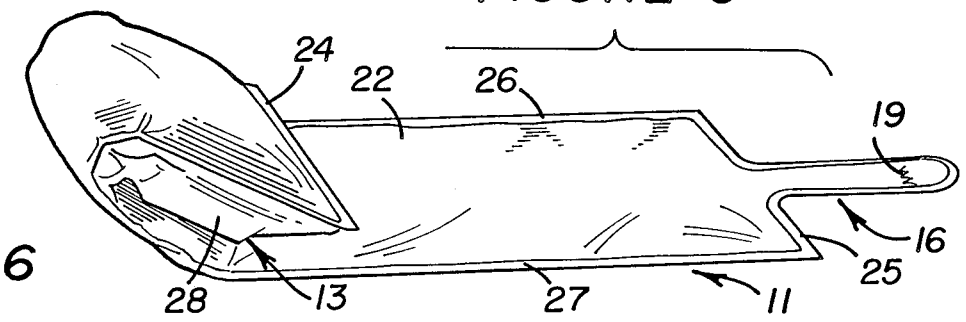
FIG. 5 is an isometric view illustrating initial rolling-up of the bag to form its spiralled configuration illustrated in FIG. 1.

As shown in FIG. 4, pouch 13 is formed by a third panel 28 secured on first panel 22 to define an open pocket adapted to retain article 14 therein. Third panel 28 is secured to the bag at first end seams 24 and side seams 26 and 27 to define the pocket so that its open side faces towards second end seam 25. Filling stem 16 extends outwardly from second end seam 26 and comprises overlying stem portions 29 and 30 of first and second panels 22 and 23, respectively, sealed together at peripheral edge portions thereof to define an inlet passage adapted to communicate pressurized air or the like to the inflatable chamber of the bag.

Each panel 22, 23, and 28 is preferably composed of a gas-impervious composite laminate, such as the type described in above-referenced U.S. Pat. No. 4,597,244. For example, each flexible panel may comprise an intermediate layer of aluminum, and outer and inner layers of a plastic heat-sealable coating, such as polyethylene, adapted to reactivate (melt) in the range of 300° F. These types of composite laminates (which may be constructed to be highly flexible and inextensible or extensible) are well known in the art and, therefore, further description thereof is deemed unnecessary to convey a full understanding of this invention. It should be understood that different types of film materials can be utilized to construct the panels to afford them various qualities, e.g., anti-static, anti-magnetic, vinyl, rubber, etc.

In the preferred embodiment of this invention, the widths of panels 22 and 23, between side seams 26 and 27, are substantially less than the lengths of the panels between end seams 24 and 25. For example, the lengths of these panels are preferably at least approximately three times greater than the widths thereof. The length of third or pouch panel 28, between end seams 24 and 25, is preferably selected from the approximate range of from one-tenth to four-tenths of the lengths of panels 22 and 23.

It should be understood that various modifications can be made to the packaging system of this invention without departing from the spirit and scope of this invention. For example, FIG. 6 partially illustrates a modified bag 11' wherein panels 22 and 23 are heat-sealed together along a plurality of parallel and laterally spaced longitudinal seams 31 extending between the end seams of the bag. Seams 31 secure the panels together to form the chamber of the bag into a plurality of subchambers 32 with the seams terminating short of second end seam 25 to communicate the subchambers with each other upon filling thereof with a filler medium, such as pressurized air.

Figure 6:
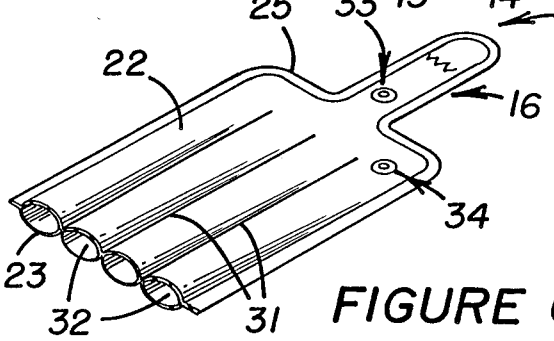
FIG. 6 is an isometric view, partially illustrating a modified bag.

FIG. 6 further illustrates the use of an optional filling means, shown in the form of a valve 33 secured to filling stem 16 or a valve 34 secured to one of the panels 22 and 23. One of the valves can be utilized in lieu of cut line 19. With the use of valve 33, cut line 19 can be eliminated from stem portion 29. When valve 34 is used, stem portion 16 could be eliminated, if so desired, with end seam 25 extending fully across the end edges of panels 22 and 23. Inflation valves 33 and 34 may be of the type disclosed in U.S. Pat. No. 4,586,910.

As briefly described above, when rolled-up bag 11 is inserted into box 12, as illustrated in FIG. 2, a standard inflation apparatus, including filler tube 18, can be utilized to charge and pressurize the inflatable chamber of the bag with air to an inflation pressure exceeding ambient pressure, e.g., exceeding 14.7 psi at sea level. In general, it is desirable that the bag's maximum air volume capacity approximate 150% of the total volume of box 12. When valve 34 is utilized (FIG. 6), the bag can be filled when closure flaps 15 of the box are open to expose the valve.

Human lung power could also be utilized to inflate the chamber of the bag with air. Other types of gases, such as helium, could be utilized as the filler medium, as well as a suitable liquid, such as water. Alternatively or in addition to the pressurized fluid, the chamber could be at least partially filled with a plastic material (e.g., urethane, polystyrene, etc.) in solid (injected in liquid form and allowed to solidify) or piece form (e.g., balls or pellets).

Panels 22, 23, and 28 can be suitably cut and sealed together by conventional apparatus and methods, such as those described in U.S. Pat. No. 4,545,844. Bead seal 20 can be suitably formed by sealing apparatus, such as the type described in U.S. Pat. No. 4,597,244, i.e., the impulse table top bag sealer Model 210-8 manufactured by A.I.M. Plastics, Inc. of mount Vernon, New York. The open end of pouch panel 28 could be suitably heat-sealed to panel 22 after article 14 is inserted into pouch 13, and prior to when bag 11 is rolled-up.

It should be understood that bag 11 could be used as a complete packaging system without the use of box 12. Further, the deflated bag could be loosely placed or secured in box 12 prior to insertion of article 14 into pouch 13. The deflated bag could be glued or otherwise suitably secured to the bottom or sidewalls of the erected box or secured to one of the sidewalls when the box is in its flattened blank form, i.e., prior to gluing of the manufacturer's glue flap, not shown, to an adjacent sidewall of the box blank. The latter arrangement contemplates formation of opening 17 through a sidewall of the box to provide access for stem 16, i.e., the bag would be oriented ninety degrees from its FIG. 1 disposition. The article could be placed in pouch 13 when the box blank and pouch are flattened or could be placed in the pouch after the blank has been erected to box form with the bag lift partially unspiralled to provide access to the pouch and then spiralled with the article placed in the pouch.

I claim:

1. A packaging system comprising a rolled-up bag generally assuming a spiralled configuration and defining a chamber therein adapted to be at least partially filled with a filler medium, said bag having first and second ends, pouch means secured adjacent to the first end of said bag to define an open pocket facing the second end of said bag for retaining an article therein, said pouch means disposed within the confines of overlying rolled-up portions of said bag and the spiralled configuration of said bag defining a plurality of overlying portions of said chamber entirely surrounding said pouch means and the article retained therein, and filling means for at least substantially charging said chamber with said filler medium to at least substantially encapsulate and support said pouch means and article within the rolled-up portions of said bag.

2. The packaging system of claim 1 wherein said bag comprises overlying first and second panels having outer peripheral edges thereof sealed together to define said chamber and said pouch means comprises a third panel secured on said first panel to define an open pocket adapted to retain said article therein.

3. The packaging system of claim 2 wherein said first and second panels are at least generally rectangular and substantially co-extensive relative to each other to define opposite first and second end seams at the first and second ends of said bag, respectively, and opposite side seams thereon and said bag being devoid of any additional seams formed transversely across said bag to facilitate rolling-up said bag to assume its spiralled configuration.

4. The packaging system of claim 2 wherein each of said first and second panels is composed of a gas impervious, flexible material.

5. The packaging system of claim 3 wherein said third panel is secured to said bag at said first end seam and at said side means to define an open pocket, said first, second and third panels forming a common bond at said first end seam and said side seams.

6. The packaging system of claim 3 wherein said filling means comprises a filling stem extending outwardly from said second end seam and means on said filling stem for receiving a source of pressurized filler medium for at least partially filling said chamber with said filler medium.

7. The packaging system of claim 6 wherein said last-mentioned means comprises means defining a cut line through said filling stem or a valve secured to said filling stem.

8. The packaging system of claim 1 wherein said filling means comprises a valve secured to one of said first and second panels.

9. The packaging system of claim 6 wherein said filling stem comprises overlying stem portions of said first and second panels sealed together at peripheral edge portions thereof to define an inlet passage therebetween communicating with said chamber.

10. The packaging system of claim 6 further comprising sealing means formed transversely across said filling stem to isolate and seal said inflating means from said chamber.

11. The packaging system of claim 3 wherein the widths of said first and second panels, between said side seams, are substantially less than the lengths of such panels between and said first and second end seams.

12. The packaging system of claim 2 wherein the lengths of said first and second panels are at least approximately three times greater than the widths thereof.

13. The packaging system of claim 11 wherein the length of said third panel, between said first and second end seams, is selected from the approximate range of from one-tenth and to four-tenths of the lengths of said first and second panels.

14. The packaging system of claim 1 further comprising a box having said rolled-up bag disposed therein and means formed through said box for providing access to said filling means.

15. The packaging system of claim 3 further comprising a plurality of parallel and laterally spaced longitudinal seams extending between said first and second seams for securing said first and second panels together to form said chamber into a plurality of subchambers, said longitudinal seams terminating short of said second end seam to communicate said sub-chambers with each other.

16. A package adapted to have an article retained therein comprising a bag having first and second ends and comprising overlying flexible first and second entirely flat panels sealed together about peripheral edges thereof to define a fillable chamber therebetween, said bag being devoid of any cross-seams formed transversely thereacross, and a third panel secured on said first panel to define an open pouch adapted to retain an article therein, said open pouch facing from the first end towards the second end of said bag.

17. The package of claim 16 wherein said first and second panels are at least generally rectangular and substantially co-extensive relative to each other to define opposite first and second end seams and opposite side seams thereon.

18. The package of claim 16 wherein each of said first and second panels is composed of a gas impervious, flexible material.

19. The packaging system of claim 17 wherein said third panel is secured to said bag at said first seam and at said side seams to define an open pocket facing said second end seam.

20. The package of claim 17 wherein said filling means comprises a filling stem extending outwardly from said second end seam and means of said stem for at least substantially filling said chamber with said filler medium.

21. The package of claim 17 wherein the widths of said first and second panels between said side seams are substantially less than the lengths of such panels between said first and second end seams.

22. The package of claim 21 wherein the length of said third panel, between said first and second seams, is selected from the approximate range of from one-tenth to four-tenths of the lengths of said first and second panels.

23. The package of claim 17 further comprising a plurality of parallel and laterally spaced longitudinal seams extending between said first and second end seams for securing said first and second panels together to form said chamber into a plurality of sub-chambers, said longitudinal seams terminating short of said second end seam to communicate said sub-chambers with each other.

24. A method for packaging an article comprising forming a package by forming a bag from overlying first and second panels to define an inflatable chamber therein and securing a third panel to said first panel at heat-sealed seams common to said first and second panels to further form an open pouch secured on said bag facing from a first end towards a second end of said bag, placing an article in said pouch, rolling-up said bag into a general spiral configuration to dispose said pouch and article within the confines of said bag and to envelope said pouch with a plurality of overlying portions of said chamber which entirely surround said pouch and said article, and at least partially filling said bag with a filler medium to at least substantially encapsulate and support said pouch and article within rolled-up portions of said bag.

25. The method of claim 24 further comprising placing said package in a box between said rolling-up and filling steps and then at least partially filling said bag with said filler medium.

26. The method of claim 25 wherein said package is placed in said box prior to placing said article in said pouch.

* * * * *